US012065765B2

(12) United States Patent
Ozden et al.

(10) Patent No.: US 12,065,765 B2
(45) Date of Patent: Aug. 20, 2024

(54) COMPOSITE YARN COMPRISING AT LEAST TWO SINGLE ELASTIC FILAMENTS AND A PLURALITY OF INELASTIC ELEMENTS

(71) Applicant: Sanko Tekstil Isletmeleri San. Ve Tic. A.S., Inegol-Bursa (TR)

(72) Inventors: Erdogan Baris Ozden, Inegol-Bursa (TR); Fatma Korkmaz, Inegol-Bursa (TR); Tuncay Kilickan, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 79 days.

(21) Appl. No.: 17/603,670

(22) PCT Filed: Apr. 17, 2020

(86) PCT No.: PCT/EP2020/060936
§ 371 (c)(1),
(2) Date: Oct. 14, 2021

(87) PCT Pub. No.: WO2020/212617
PCT Pub. Date: Oct. 22, 2020

(65) Prior Publication Data

US 2022/0195638 A1 Jun. 23, 2022

(30) Foreign Application Priority Data

Apr. 17, 2019 (EP) ..... 19169983

(51) Int. Cl.
*D02G 3/32* (2006.01)
*D03D 15/56* (2021.01)

(52) U.S. Cl.
CPC ..... *D02G 3/32* (2013.01); *D03D 15/56* (2021.01); *D10B 2501/00* (2013.01)

(58) Field of Classification Search
None
See application file for complete search history.

(56) References Cited

U.S. PATENT DOCUMENTS 3,940,917 A * 3/1976 Strachan ..... D04B 1/18 57/208
4,554,121 A 11/1985 Kramers
2008/0268734 A1* 10/2008 Tharpe ..... D02G 3/328 57/226

FOREIGN PATENT DOCUMENTS

| | | |
|---|---|---|
| CN | 107700030 | 2/2018 |
| CN | 208328238 | 1/2019 |
| KR | 20010086606 | 9/2001 |
| WO | 2008130563 | 10/2008 |

OTHER PUBLICATIONS

International Search Report issued by the EPO on May 29, 2020 for International application No. PCT/EP2020/060936.

* cited by examiner

*Primary Examiner* — Shawn Mckinnon

(57) ABSTRACT

A composite yarn (100) comprising at least two single elastic filaments (101) and a plurality of inelastic elements (103), wherein said inelastic elements (103) comprise a plurality of inelastic filaments and/or a bundle of inelastic filaments, and said single elastic filaments (101) and said inelastic filaments (103) are connected to each other by intermingling.

21 Claims, 5 Drawing Sheets

COMPOSITE YARN COMPRISING AT LEAST TWO SINGLE ELASTIC FILAMENTS AND A PLURALITY OF INELASTIC ELEMENTS

This application is a U.S. national stage of PCT/EP2020/060936 filed on 17 Apr. 2020 which claims priority to and the benefit of European Application No. 19169983.4 filed on 17 Apr. 2019, the contents of which are incorporated herein by reference in their entireties.

FIELD OF THE INVENTION

The present invention relates to elastic yarns, and in particular to composite elastic yarns. The yarns of the invention find application in particular in the production of fabrics for high elasticity garments, e.g. jeggings and similar garments.

BACKGROUND OF THE INVENTION

Elastane or Spandex filaments and yarns are known in the art and have been widely used in the textile field for producing elastic yarns and fabrics. Filaments of elastane are produced by extrusion of the polymer through a spinneret having several extrusion cells. Before the filaments exit the extrusion machine, an amount of solid single filaments, or strands, are coalesced together to produce a bundle of filaments having the desired count, i.e. the desired thickness. Thus, each bundle of filaments of elastane (spandex) is made up of many smaller individual fibers that adhere to one another because of the natural stickiness of their surface.

The bundle of elastane filaments are used to prepare yarns. It is known to produce elastic yarns by combining a single bundle of elastane filaments with a plurality of substantially inelastic (or substantially non-stretchable) polyester filaments.

These kinds of elastic yarns provide some problems when used for producing high elasticity fabrics. The main issue with this kinds of fabrics are known as "elastane breakage" and "elastane slippage", i.e. breaking of the elastic yarns and sliding of the elastic yarn from a seam to the interior of the fabric, especially on the sewing edge area mainly on the both of hips side and crotch of the garment.

These problems may arise e.g. while sewing with overlock seam or folded seam, or when performing a dry scraping process, or during washing in industrial laundry machines, or during drying in tumble dryer, during home washing, etc.

WO2008130563 discloses a composite yarns have a filamentary core provided with at least one elastic performance filament and at least one inelastic control filament. A fibrous sheath, preferably formed from spun staple fibers, surrounds the filamentary core, preferably substantially along the entire length thereof. The at least one elastic performance filament most preferably includes a spandex and/or a lastol filament. This kind of yarn provides for a cotton sheath, which is not desirable for the present invention.

SUMMARY OF THE INVENTION

It is an aim of the present invention to solve the above mentioned problems and provide yarns that, when used in high elasticity garments, are not (or at least less) affected by breakage and "slippage" of the elastic yarns.

This and other objects are reached by the present solution according to one or more of the enclosed claims.

An aspect of the invention relates to a composite yarn, a fabric, an article and a process according to the independent claims, while preferred aspects are recited in the dependent claims.

According to an aspect, a composite yarn comprises at least two single elastic filaments and a plurality of inelastic elements. The inelastic elements may be different inelastic filaments, or different bundles of inelastic filaments. The single elastic filaments and the inelastic filaments are connected via intermingling.

Intermingling is thus used to couple the single elastic filaments and the inelastic elements that, before intermingling, were typically substantially separate elements.

As mentioned, the elastic filaments are "single", i.e. they are not part of the same elastic bundle of continuously connected filaments. It is in fact known that for elastic textile elements, an amount of filaments may be bundled together to produce the desired thickness. It is e.g. known that a yarn of spandex is a bundle of filaments, as spandex yarns may be composed of a plurality smaller individual filament that adhere to one another because of the natural stickiness of their surface. On the contrary, with "single elastic filament" is meant a monofilament "yarn".

The single filaments are "elastic" as they can be stretched (as elongation at break) between 50% and 1000% according to DIN 53820 part 2).

The inelastic element is "inelastic" as it has an elongation at break less than the single elastic filaments, preferably less than 75%, more preferably less than 50% than the elastic filaments. Typically, the inelastic element is provided with an elongation at break between 5% and 100% according to DIN ISO 2062).

In the claimed solution there are at least two, and preferably more than two, single elastic filaments that do not behave and move (and thus possibly break) like a single element but, even if intermingled with the inelastic elements, retain a certain independency one from the other. This fact provides a better resistance to stresses, and in particular it may limit damage only to part of the elastic filaments. According to a preferred aspect, to help retain the above mentioned independency of behavior, the single elastic filaments are not coupled one to the other before intermingling. In other words, according to a preferred aspect, the elastic filaments remain in a separate state before intermingling. They can be fed to the intermingling device one close to the other, so that they may touch one with the other, but they are not twisted one with the other.

Preferably, the composite yarn essentially consists in the above mentioned single elastic filaments and inelastic elements. In particular, according to a preferred aspect, the composite yarn as above discussed is not used as a core of a core-sheath yarn. In other words it is not covered by means of a sheath of e.g. staple fibers.

According to an aspect, the composite yarn consists of elastic and inelastic filaments. All the elastic filaments of the yarn can be single elastic filament. However, it is possible that the composite yarn, in addition to single elastic filaments, comprises elastic filaments that are part of a bundle of elastic connected filaments. In other words, embodiments of the present invention can be provided with single elastic filaments and also with bundle of connected elastic filaments.

In preferred embodiments, there are more than two elastic filaments. Embodiments of the present invention may in fact be provided with at least three elastic filaments, or at least five elastic filaments, or at least ten elastic filaments.

Exemplary and preferred embodiments are provided with 2 to 22 single elastic filaments.

As a general concept, the number and count of inelastic elements is not limited. Preferably, however, the total count of inelastic elements is equal or greater than the total count of the elastic filaments. In other words, preferably, the percentage in weight of the inelastic elements in the composite yarns is equal to, or more preferably greater than, the percentage in weight of the elastic filaments in the composite yarn. In the final yarn, the elastic filaments may be between 5% and 50% by weight of the final composite yarn.

Also, according to an aspect, the number of inelastic elements in the composite yarn is greater than the number of the elastic filaments in the final yarn.

According to an aspect, each of the inelastic element comprises at least one polyester filament and/or a polyamide filament and/or a polyester copolymer, and/or a polyamide copolymer.

Objects of the present invention relate also to a fabric, preferably a woven fabric, comprising a composite yarn according to one or more of the above aspects, and to an article, preferably a garment, comprising such a fabric.

In addition, the present invention relates to a process for producing a composite yarn comprising the steps of: providing a plurality of inelastic elements, each inelastic element being selected between a filament or a bundle of filaments; providing at least two separate single elastic filaments; intermingling the single elastic filaments and the inelastic elements; collecting the composite yarn obtained via the intermingling step. Preferably, intermingling is carried out via air-jet intermingling.

By using a plurality of bundles of coalesced elastic filaments and a plurality of inelastic filaments and by intermingling them into entanglement points, or knots, it is possible to obtain a final yarn that has no or very reduced elastane slippage; the elastic the yarn may actually be also be used as such, without further treatments.

Exemplary and non-limiting embodiments are now discussed with reference to the following figures, wherein.

DETAILED DESCRIPTION OF EXEMPLARY EMBODIMENTS

A composite yarn 100 comprises at least two single elastic filaments 101.

Figure 5:
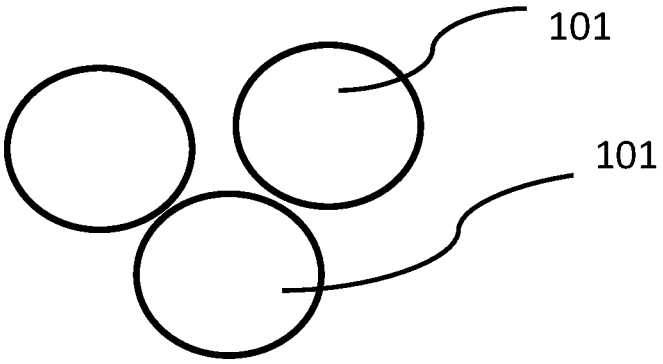
FIG. 5 is a schematic section view of tree single filaments.
Figure 6:
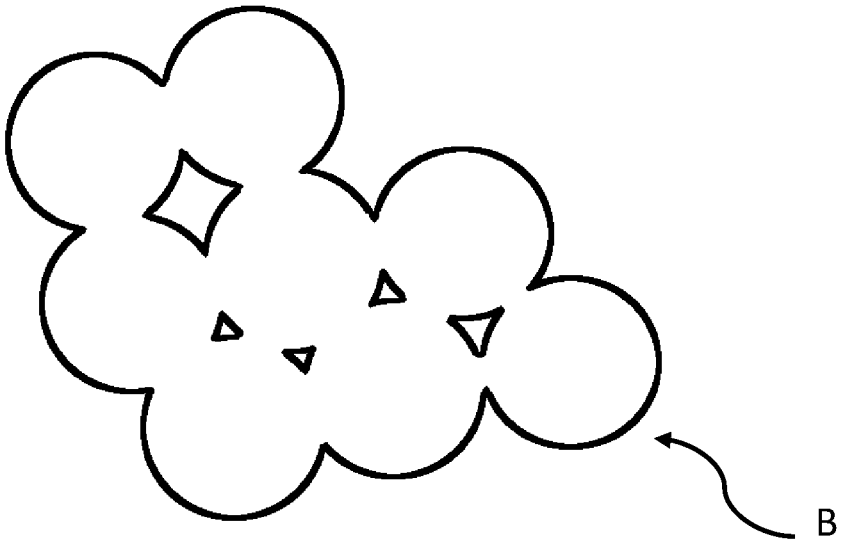
FIG. 6 is a schematic view of a bundle of continuously connected elastic filaments.

Three single elastic filaments (monofilaments) are schematically shown in FIG. 5. As above discussed, providing single elastic filaments is different from a bundle B of continuously connected filaments, schematically shown in FIG. 6, where all the filaments behave like a single element. Contrary to that, even if intermingled, as better discussed later, single elastic filaments (monofilaments) retain some independency of movement one from the other, in particular at a distance from the connection points P provided by intermingling.

Preferably, the number of elastic filaments is equal or greater than two, and it is preferably equal or greater than three, more preferably equal or greater than seven, eve more preferably equal or greater than ten and up to 50.

Some embodiments of the present invention are provided with a number of single elastic filaments comprised between 2 and 50.

The single elastic filaments are preferably elastomeric filaments, i.e. filaments that can be stretched repeatedly at room temperature to at least twice their original length and which after removal of the tensile force will immediately and forcibly return to approximately their original length. According to an aspect, the elastic filaments 101 are polyurethane filaments, such as elastane filaments.

The count of each elastic filament 101 is preferably comprised between 2 to 100 denier, preferably 10 to 100 denier, more preferably 10 to 70 denier.

The composite yarn 100 comprises a plurality of inelastic elements 103. In the shown embodiment, the inelastic elements 103 are part of a bundle of inelastic filaments. As a result, in the shown embodiment, an inelastic element corresponds to an inelastic filament. Different embodiments may provide that an inelastic element is a bundle of connected (e.g. bonded) inelastic filaments. Count of each inelastic filament is lower than the count of the elastic filament 101. Preferred inelastic filaments have a count comprised between 0.5 and 3 den.

In general, the composite yarn 100 comprises a plurality of inelastic elements 103, where the inelastic element can be a single inelastic filament or a bundle of inelastic filaments.

The inelastic elements 103 are preferably single filaments (monofilaments) of partially oriented yarn (POY), known in the art. Preferable filaments for the inelastic elements 103 are selected from polyester filaments and polyamide (nylon) filaments, or filament made in polyester or polyamide copolymers. The inelastic filaments are preferably textured filaments.

The inelastic elements 103 may also comprise filaments that are bi-component filaments, such as PBT/PTT or PET/PTT or PET/PTMT bi-component filaments.

The elastic filaments 101 and the inelastic elements 103 are connected to each other at a plurality of points P, via intermingling, to provide the final composite yarn 100. As a result, in the final composite yarn 100, there are portions of the single elastic filaments 101 that are not connected to the inelastic element 103 (i.e. between two subsequent connection points P), and that can behave in substantially independent manner one from the other. As above mentioned, to help providing such an independency, it is preferred that, as shown in the figures, the elastic filaments 101 are fed as independent filaments, or at least in a non-twisted state, to the intermingling device.

As mentioned, the inelastic elements comprise (or consist in) inelastic filaments. The number and/or the total count of the inelastic filaments is preferably greater than respectively the number and/or the total count of the elastic filaments, even if, as mentioned, the count of one inelastic filament of the yarn has preferably a count lower than the count of one elastic filament of the yarn.

In other words, the percentage in volume of the inelastic filaments in the final composite yarn is greater than (at worst equal to) the percentage in volume of the elastic filaments in the final composite yarn and/or the percentage in weight of the inelastic filaments in the final composite yarn is greater than (at worst equal to) the percentage in weight of the elastic filaments in the final composite yarn. Intermingling is preferably provided via air jet intermingling.

Figure 1:
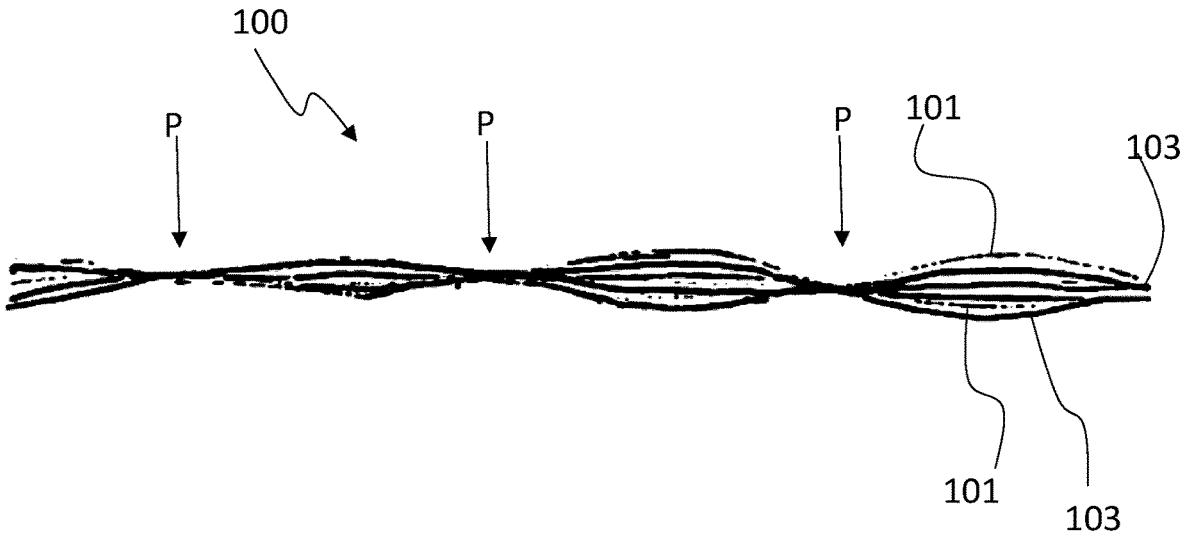
FIG. 1 is a schematic view of a portion of a composite yarn according to an embodiment of the invention.
Figure 2:
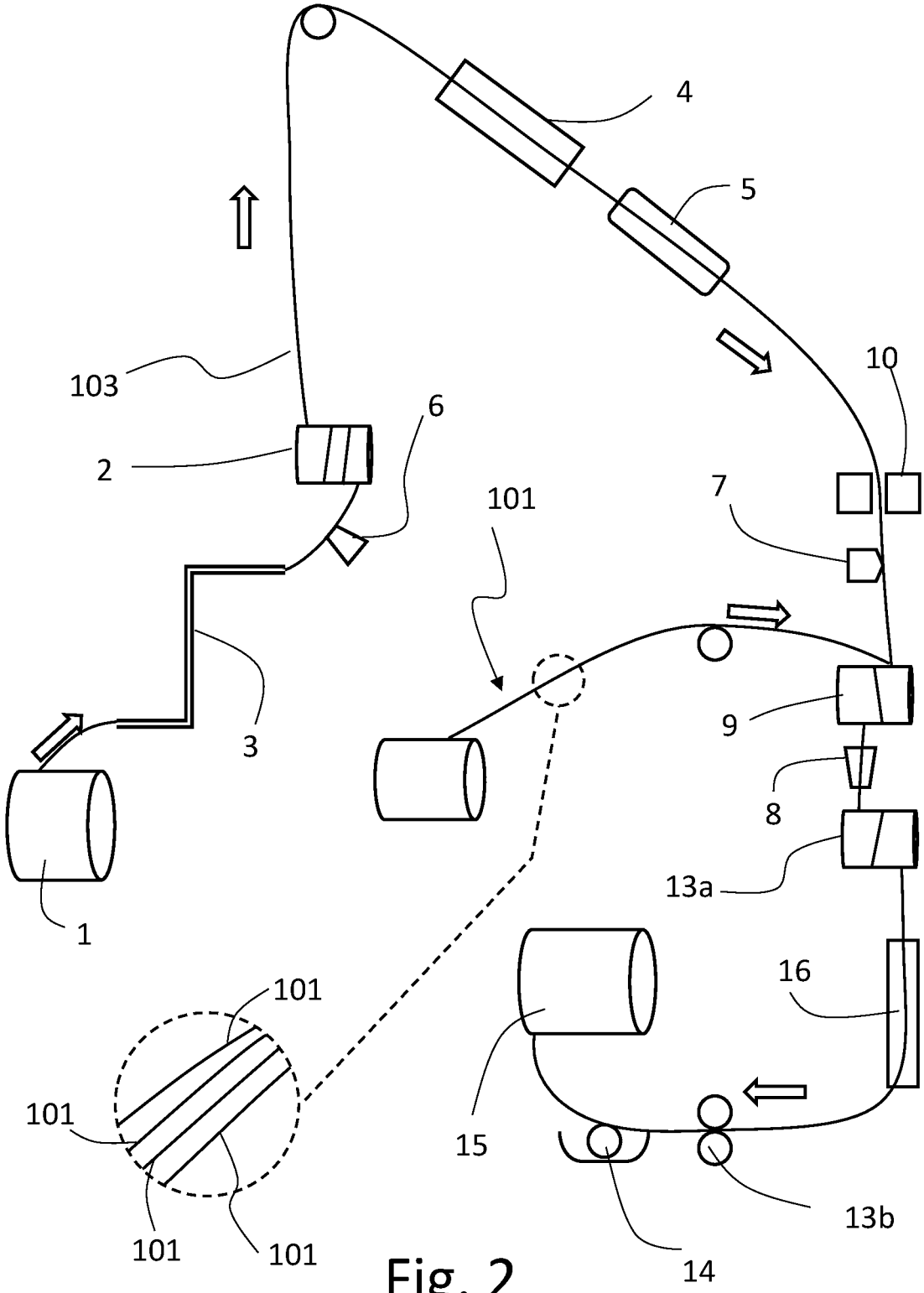
FIG. 2 is a schematic view of a possible apparatus for producing a composite yarn as per FIG. 1.
Figure 3:
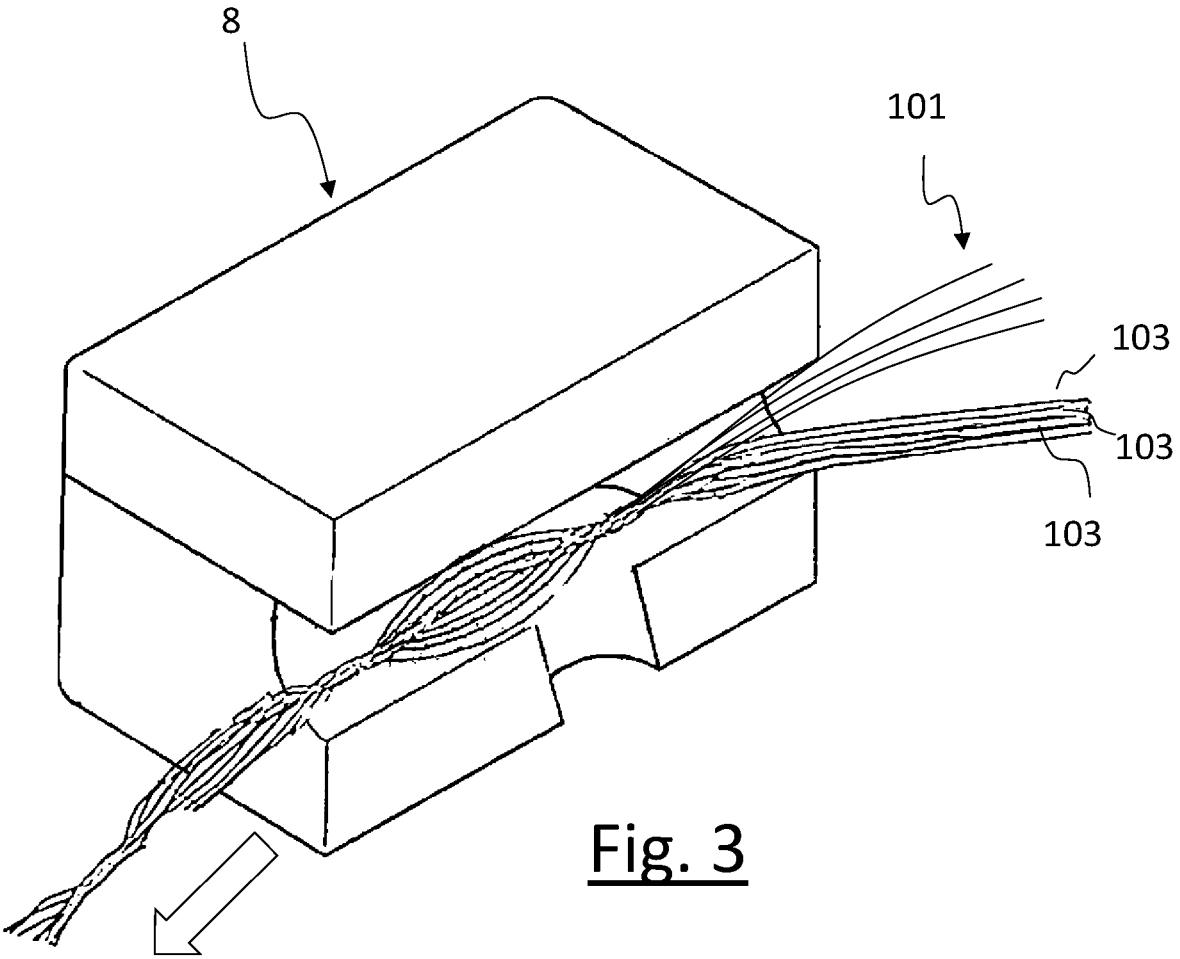
FIG. 3 is a schematic view of an intermingling device, that may be used in an apparatus as per FIG. 2.
Figure 4:
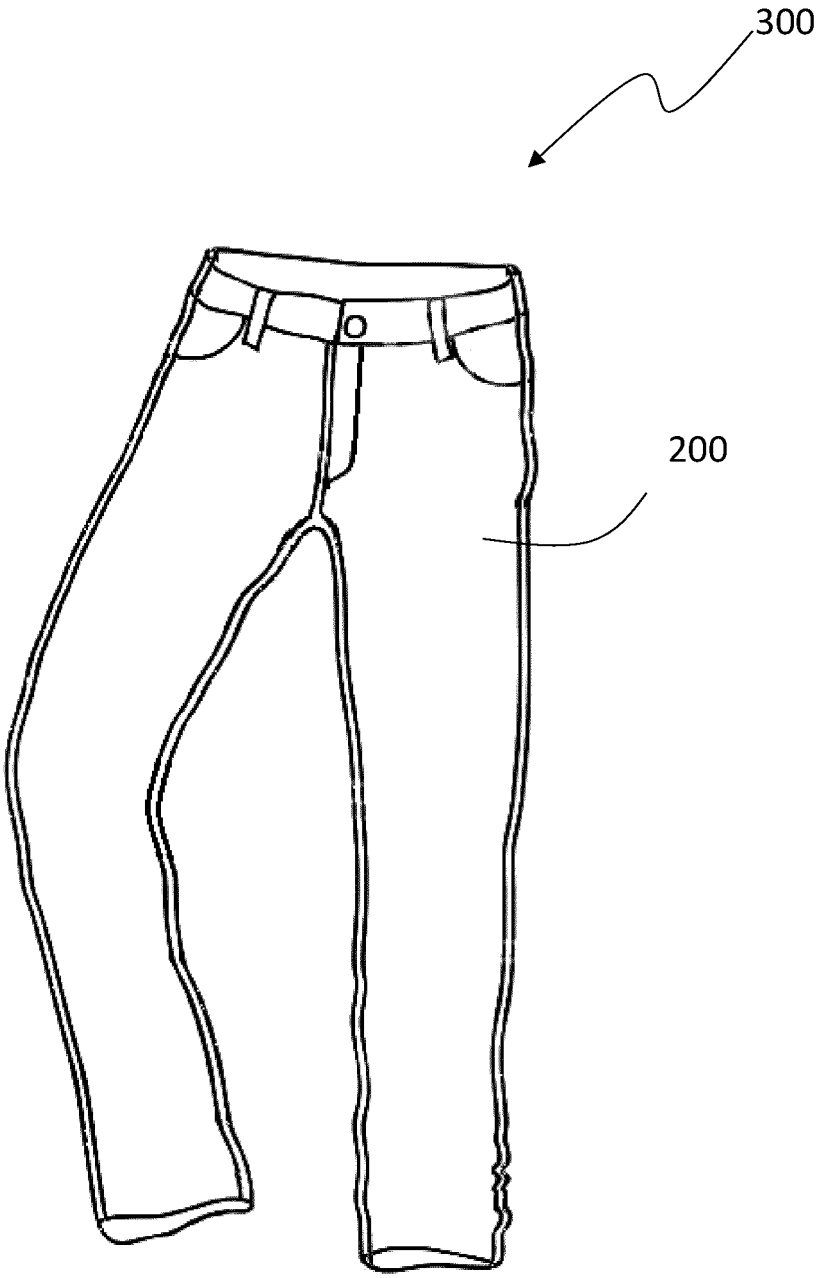
FIG. 4 is a schematic view of a garment obtained comprising a fabric comprising in turn a composite yarn as per FIG. 1.

The composite yarn 100 is typically used to provide a fabric 200, preferably a woven fabric. An aspect of the invention relates to an article 300, typically a garment, that comprises such a fabric 200. According to possible embodiments, as the one shown in FIG. 2, during the process for producing a composite yarn according to the present invention, the inelastic elements 103 are provided by one or more sources 1, e.g. one or more bobbins. In the shown embodiment, a single source 1 provides a bundle of separate inelastic elements (i.e. inelastic filaments) 103.

Each source of inelastic filaments may have different counts/denier of filaments and at final product there may be combination of different counts/denier of total filaments such as 40D/4F (40 Denier with 4 Filaments)+30D/3F (30 Denier with 3 Filaments) The inelastic elements 103 can be passed through a guide 3, e.g. a tube, and drafted via drafting means 2, e.g. one or more drafting rollers.

Each of the elastic filament may be drawn with different levels of draft ratios before being intermingled.

The inelastic elements 103 may be also heat treated, e.g. via a heating element 4, possibly followed by a cooling element 5, e.g. a heating chamber and a cooling chamber through which the inelastic elements 103 are passed. Temperature of the first heating element can be between 180 and 210° C.

Sensor(s) 6 may be provided to verify whether a breakage of the inelastic elements occurs during the process, so as to monitor and avoid that they are no more withdrawn from the source 1. Further sensors 7 may be provided to verify the tension of the inelastic elements 103.

Elastic filaments 101 are withdrawn from one or more relevant sources 11. It is possible, such as in the shown embodiment, that a single source 11 (e.g. a single bobbin) is provided with a plurality of single elastic filaments 101, in a known manner. As a result, for at least a part of their path, the single elastic filaments 101 and the inelastic elements 103 run along different and separate paths.

The inelastic elements 103 and the single elastic filaments 101 are then connected together at a plurality of connection points P via an intermingling device 8, preferably an air-jet intermingling device.

As mentioned, the intermingling device provides a plurality of connection points P between the filaments of the final yarn. In particular, as known, intermingling provides a plurality of connection pints P (knots) between the filaments 101, 103 of the final yarn. There are known ways and testing machines to measure the number of entanglement, i.e. knots, per meter on a yarn, e.g. by evaluating the variations in the thickness of the yarns. As an example, in ITEMAT+ by Textechno H. Stein (Moenchengladbach, DE; https://www.textechno.com) in an "interlace test" a yarn is passed between two cylinders at a pre-determined elongation, to evaluate the number of the intermingling points. At each intermingling point there is provided an entanglement or knot of the elastic and inelastic filaments that remains also when the yarn is tensioned or stretched and that can be sensed by the testing machine in the otherwise smooth yarn.

Preferably, when tested with a similar machine, and when stretched with an elongation at 6.0%, a yarn according to the invention is provided with at least 50 connection points (i.e. knots) per meter, more preferably at least 80 connection points/knots per meter, even more preferably at least 100 entanglements/knots per meter. A suitable number of knots is in the range of up to 120 knots/meter e.g. 80 to 120 knots/meter.

According to a preferred aspect, the inelastic elements 103 are overfed to the intermingling device 8, preferably at a percentage between 1.2% and 7.0%.

Before intermingling, the elastic filaments 101 can be passed together in a drafting device 9, e.g. a drafting roller. Preferably, the drafting of drafting device 9 (applied to both elastic filaments 101 and inelastic elements 103) is greater than the drafting applied to the inelastic elements 103 by drafting device 2 (placed upstream of the drafting device 9). In particular, the drafting applied to drafting device 9 can be between 1.5 and 1.8 greater than the drafting applied by drafting device 2.

Preferably, the draft of the elastic filaments 101 is between 1.1 and 6.9 more preferably 2 to 6, even more preferably 3 to 5. Regarding the inelastic elements 103, draft is preferably lower than 6, more preferably lower than 5, even more preferably lower than 4. In addition, the elastic filaments 101 are preferably drafted more than inelastic elements 103.

In addition, before being connected to the elastic filaments 101, the inelastic elements 103 may be texturized, via a texturing device 10. Any suitable texturizing device, such as a friction discs device, may be used.

After intermingling, a composite yarn is formed, where the single elastic filaments 101 and inelastic elements 103 are connected via intermingling.

Further finishing processes may be carried out, e.g. a heat treatment via a heating chamber 16 and/or a further drafting via one or more drafting device 13, and/or application of a finishing agent, e.g. an oil or a similar element, via a finishing device 14.

The composite yarn 100 is finally collected on a collecting element 15; typically it is wound on a bobbin.

In an embodiment, during the production process, substantially no further yarns, rovings, slivers or similar textile elements are added to the composite yarn 1, that can thus be used in such a form, i.e. essentially comprising the single elastic filaments 101 (and possible the bundle of elastic filaments) and the inelastic elements 103 as a yarn to manufacture a fabric, in particular a woven fabric 200, for an article 300, such as a garment.

The invention claimed is:

1. A composite yarn (100) comprising at least two single elastic filaments (101) and a plurality of inelastic elements (103), wherein:

said inelastic elements (103) comprise a plurality of inelastic filaments and/or a bundle of inelastic filaments;

said at least two single elastic filaments (101) and said inelastic filaments (103) are intermingled and said at least two single elastic filaments (101) are substantially independent of one another except at entanglement points, wherein said entanglement points comprise greater than 100 entanglement points per meter, the inelastic filaments are single filaments of a partially oriented yarn with the denier per filament of the inelastic filaments being less than the elastic filaments and the denier per filament of the inelastic filaments being 0.5-3.

2. The composite yarn (100) according to claim 1, wherein said inelastic elements (103) comprise said plurality of inelastic filaments and said at least two single elastic filaments (101) are not coalesced.

3. The composite yarn (100) according to claim 1, wherein each of said inelastic elements comprise at least one polyester filament and/or a polyamide filament.

4. The composite yarn (100) according to claim 1, wherein a count of each of said inelastic filaments (103) is less than a count of each of said single elastic filaments (101) and a percentage in weight of said plurality of inelastic elements (103) is greater than a percentage in weight of said at least two single elastic filaments (101) in said composite yarn (100).

5. The composite yarn (100) according to claim 1, wherein the elastic filaments (101) are drafted with a draft between 1.1 and 6.9.

6. The composite yarn (100) according to claim 5, wherein the draft of the inelastic elements (103) is lower than 5.

7. The composite yarn (100) according to claim 5, wherein the draft of the inelastic elements (103) is less than the draft of the elastic filaments (101).

8. The composite yarn (100) according to claim 1, wherein the inelastic elements (103) are texturized.

9. The composite yarn (100) according to claim 1, wherein said inelastic elements (103) comprise bi-component filaments.

10. The composite yarn (1) according to claim 1, wherein said single elastic filaments (101) have a count between 40 and 70 denier.

11. The composite yarn (1) according to claim 1, further comprising at least a bundle of elastic filaments intermingled with the inelastic elements (103).

12. A fabric (200), comprising a composite yarn according to claim 1.

13. An article (300) comprising a fabric (200) according to claim 11.

14. A process for producing a composite yarn (100) comprising the steps of:

a. providing a plurality of inelastic elements (103), said inelastic elements comprising a plurality of inelastic filaments or a bundle of inelastic filaments;

b. providing at least at least five separate single elastic filaments (101);

c. intermingling said single elastic filaments (101) and said inelastic elements (103); and d. collecting the composite yarn (100) obtained via said intermingling step, wherein said at least five separate single elastic filaments (101) are fed as individual filaments and therefore not coupled together prior to said intermingling and are substantially independent of one another except at said entanglement points, after said intermingling, the inelastic filaments are single filaments of a partially oriented yarn with the denier per filament of the inelastic filaments being less than the elastic filaments and the denier per filament of the inelastic filaments being 0.5-3.

15. The process according to claim 14, wherein no further yarn or roving or sliver is added to the composite yarn (100) between said steps c and d.

16. The process according to claim 14, comprising the step of texturing the inelastic elements (103).

17. The process according to claim 14, wherein said inelastic elements (103) are overfed during said step c, at a percentage between 1.2% and 7.0%.

18. A composite yarn obtainable by means of a process according to claim 14.

19. The composite yarn (100) according to claim 9, wherein said inelastic elements (103) are selected from the group consisting of: PET/PTT, PBT/PTT and PET/PTMT.

20. A composite yarn (100) comprising at least five single elastic filaments (101) and a plurality of inelastic elements (103), wherein:

said inelastic elements (103) comprise a plurality of inelastic filaments and/or a bundle of inelastic filaments;

said at least five single elastic filaments (101) and said inelastic filaments (103) are intermingled and said at least five single elastic filaments (101) are substantially independent of one another except at entanglement points, wherein said entanglement points comprise greater than 100 entanglement points per meter, a count of each of said inelastic filaments (103) is less than a count of each of said single elastic filaments (101) and a percentage in weight of said plurality of inelastic filaments (103) is greater than a percentage in weight of said at least five single elastic filaments (101) in said composite yarn (100), and the inelastic filaments are single filaments of a partially oriented yarn with the denier per filament of the inelastic filaments being less than the elastic filaments and the denier per filament of the inelastic filaments being 0.5-3.

21. The process according to claim 14, wherein said collecting the composite yarn (100) obtained via said intermingling step comprises the composite yarn (100) comprising a count of each of said inelastic filaments (103) being less than a count of each of said single elastic filaments (101) and a percentage in weight of said plurality of inelastic filaments (103) being greater than a percentage in weight of said at least five single elastic filaments (101) in said composite yarn (100).

* * * * *